US005342008A

United States Patent [19]

Kay

[11] Patent Number: 5,342,008

[45] Date of Patent: Aug. 30, 1994

[54] ATTACHMENT FOR A LADDER

[76] Inventor: Derek J. Kay, 85 Railway Road, Urmston, Manchester, M31 1YD, Great Britain

[21] Appl. No.: 90,952

[22] Filed: Jul. 13, 1993

[51] Int. Cl.[5] ..... A47G 29/02

[52] U.S. Cl. ..... 248/238; 182/129; 248/210

[58] Field of Search ..... 248/210, 211, 238, 311.2; 182/121, 122, 129, 120

[56] References Cited

U.S. PATENT DOCUMENTS

| | | | |
|---|---|---|---|
| 1,211,906 | 1/1917 | Albertson | 248/238 |
| 1,455,220 | 5/1923 | Myers | 248/238 X |
| 2,162,022 | 6/1939 | Mansfield | 248/210 |
| 2,687,264 | 8/1954 | Bowen | 248/210 |
| 2,883,134 | 4/1959 | Halloran | 248/210 |
| 3,126,186 | 3/1964 | Halligan | 182/129 X |
| 4,386,753 | 6/1983 | Smith . | |
| 4,730,802 | 3/1988 | Chatham et al. . | |
| 4,949,925 | 8/1990 | Gorecki | 182/129 X |
| 5,236,161 | 8/1993 | Haven | 248/210 |

FOREIGN PATENT DOCUMENTS

| | | |
|---|---|---|
| 0173385 | 12/1987 | European Pat. Off. . |
| 125682 | 5/1928 | Switzerland . |
| 2192025 | 12/1987 | United Kingdom . |
| 2251649 | 7/1992 | United Kingdom . |

*Primary Examiner*—J. Franklin Foss

*Attorney, Agent, or Firm*—Dennison, Meserole, Pollack & Scheiner

[57] ABSTRACT

Brackets (30, 40) are mounted to respective sides of a hinged step ladder by spaced apart divergent channel forming means (31, 32) on each bracket fitting onto respective swing apart limbs (14, 16) of the erect ladder. The brackets (30, 40) each include a support portion (36), extending beyond one of the channel forming means (32), both to the same side of the ladder, onto which a tray or the like (50) is secured by fastening means (41) so as to provide a stable platform for tool and materials at a convenient height for a user of the ladder. One of the channel forming means (32) may be pivotally adjustable.

In an alternative embodiment (FIGS. 13 to 15) one of the channel forming means of each bracket is adjustable in position relative to the other so that the channels may be selectively disposed substantially parallel to each other to fit to a single limb of a ladder or divergent from each other for engagement around opened limbs of a hinged ladder.

12 Claims, 4 Drawing Sheets

ATTACHMENT FOR A LADDER

BACKGROUND AND SUMMARY OF THE PRESENT INVENTION

This invention relates to an attachment for a hinged ladder, although some embodiments are optionally also mountable to a conventional straight ladder.

In this specification the term "hinged ladder" is to be understood as meaning a free-standing ladder consisting of either a flight of steps and a hinged support, or two flights of steps hinged together.

An object of the invention is to be able to provide a holder or support surface for tools or material which a user of the ladder may require at a convenient position above the level of a top step or top platform of the ladder, or indeed at any convenient position along the length of the ladder. A further object is to be able to provide a holder or support surface which is not liable to upsetting or de-stabilizing the ladder itself.

A ladder attachment comprising a pair of brackets, each adapted for engaging a single limb of a ladder, and a storage compartment which is hingedly connected thereto is described in EP-A-O 173 385.

According to one aspect of the present invention a hinged ladder attachment comprises a pair of brackets each having engagement provisions for sides of both limbs of the hinged ladder below but close to hinging of those limbs, and a platform which is carried or to be carried by the brackets.

More specifically, the invention provides a hinged ladder attachment assembly comprising a pair of brackets, each having spaced apart divergent first and second channel means adapted for engagement around opened limbs of a hinged ladder at respective sides thereof and each having a support portion extending beyond the first channel means in a direction away from the second channel means, a platform capable of being supported by the brackets by being dimensioned to extend across the support portions of both of the brackets, when the latter are mounted on the ladder, and means for securing the platform to both said support portions.

The channel means may be provided as fixed lateral projections from a plate, such projections being of angled cross-section.

In advantageous embodiments of the invention one of the channel means is provided as a fixed lateral projection from a plate while the other is provided as a separate elongate angled profile which is mounted on the plate for pivoted adjustment thereon so that its angle relative to the fixed channel can be varied. In this way, the angle of divergence between the channel means can be matched to the angle adopted between fully opened limbs of any particular hinged step ladder.

In other advantageous embodiments of the invention the bracket is also formed in two parts, the first part comprising a plate having a pair of channel-forming means projecting from respective surfaces thereof and disposed symmetrically back to back, and the second part consisting of a separate channel-forming element which is attachable to either surface of the plate in spaced, divergent relationship with either one of the first mentioned channel forming means. In this way, a single configuration of bracket can be adapted to fit to either side of a hinged ladder, with its support portion for support of the platform always projecting in the same direction. This will avoid the need for production of two different, right and left sided brackets, thus simplifying the manufacturing process and/or enabling use of only a single moulding tool where the bracket is moulded of plastics material.

The invention also provides a ladder attachment assembly comprising a pair of brackets each having spaced apart first and second channel means adapted for engagement around limbs of a ladder at respective sides thereof and each having a support portion extending beyond the first channel means in a direction away from the second channel means, a platform capable of being supported by the brackets, and means for securing the platform to both said support portions, characterised in that the first or second channel means of each bracket is adjustable in position relative to the other channel means of the bracket so that the channel means may selectively be disposed substantially parallel to each other for fitting to parallel limbs of a ladder or divergent from each other for engagement around opened limbs of a hinged ladder.

The other advantageous features of pivotal adjustment of the position of one of the channel means of each bracket and of provision of a third channel means back to back with the fixed channel means, and other general constructional features are all equally possible with this latter type of attachment assembly which can optionally be used on a straight ladder.

Three specific embodiments of the invention will now be described, by way of example, with reference to the accompanying drawings, in which.

DETAILED DESCRIPTION OF PREFERRED EMBODIMENTS

Figure 1:
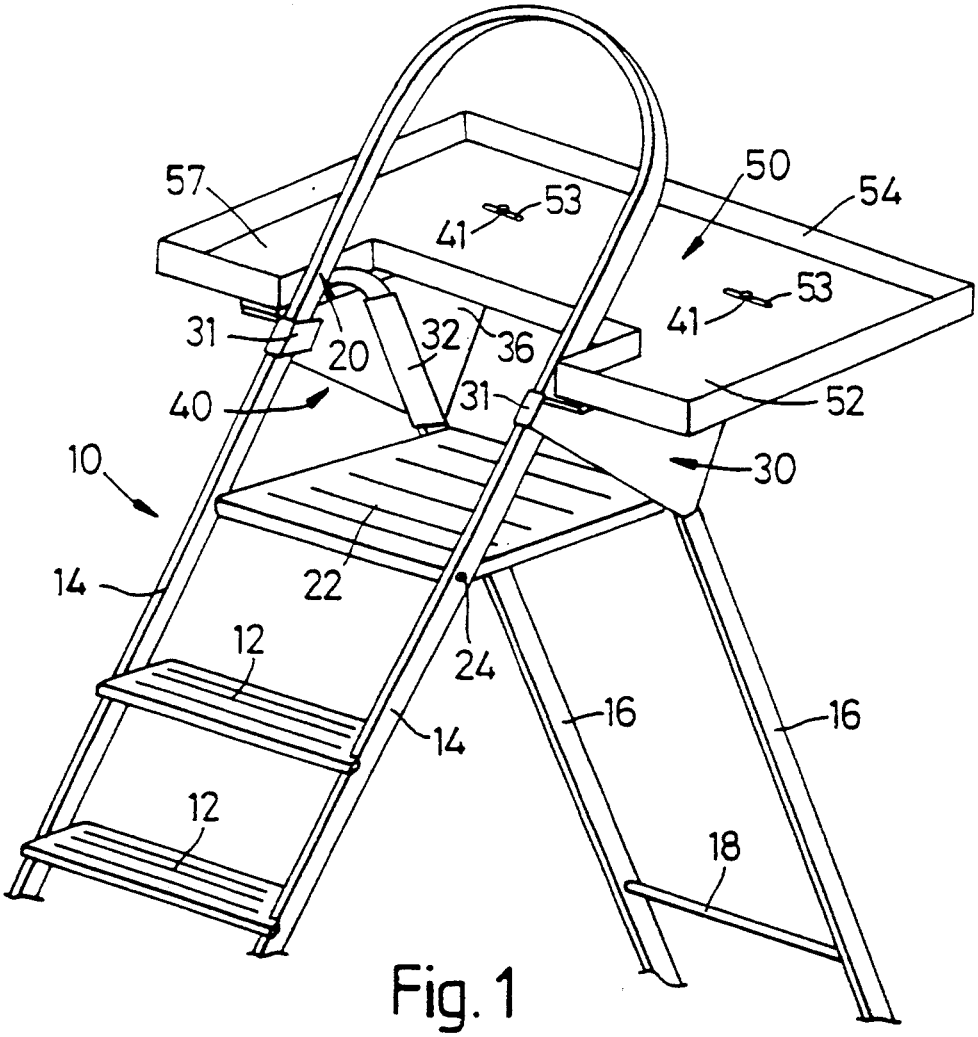
FIG. 1 is a diagrammatic perspective view of a first embodiment of the attachment assembly of the invention mounted onto an upper part of a hinged step ladder.
Figure 3:
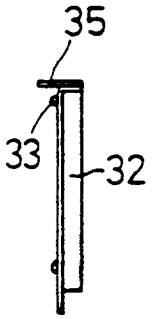
FIGS. 3 and 4 are end views of the bracket of FIG. 3 in the direction of arrows C and D, respectively.
Figure 2:
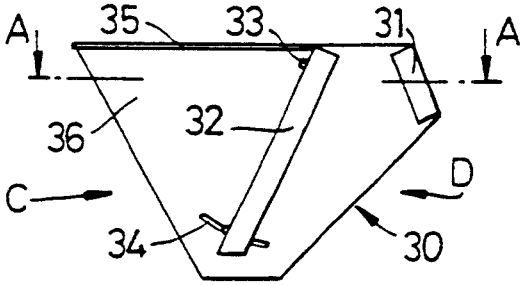
FIG. 2 is a schematic side view of one of the brackets of the assembly of FIG. 1.
Figure 4:
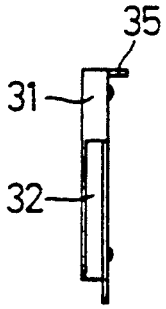
Figure 5:
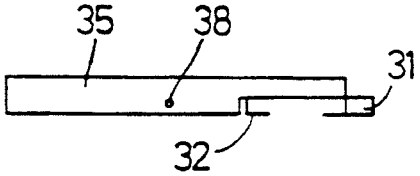
FIG. 5 is a schematic plan view of the same bracket.
Figure 6:
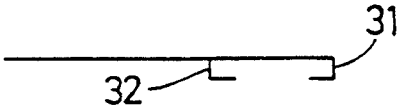
FIG. 6 is a schematic section of line A—A of FIG. 2.

FIG. 1 shows a step ladder 10 having a flight of treads 12 extending between side rails 14 as a first limb and untredded side rails 16, linked by cross pieces 18, as a second limb, the respective rails 14,16 being hinged together at 20. A customary top platform 22, which determines the angle between the limbs of the ladder when erect, is hinged at 24 to the rails 14 and has a lip (not shown) engaging over an upper cross piece (not shown) of the second limb.

An attachment assembly in accordance with the invention is shown mounted thereon and comprises two brackets 30,40 and a platform in the form of a tray 50.

With reference to FIGS. 2 to 6, the bracket 30 is shown to be of generally plate like form with a pair of spaced apart, inwardly facing divergent channel means 31,32 provided on one surface thereof. The channel means 31,32 are both elongate, but 31 is of lesser extent than 32. The channel means 31 is provided as an integral L-sectioned lateral projection along one edge of the bracket. The channel means 32 is provided as a separate L-sectioned profile which, near its upper end, is pivotally connected to the plate at 33, e.g. by means of a pivot pin or bolt. Near its lower end, it is securable to the plate at any selected angle relative to the channel means 31 by means of a wing nut or the like projecting through an arcuate slot 34 in the plate. A portion 36 of the plate extends beyond the channel means 32. The plate has a flange 35 along its upper edge, which flange 35 projects to both sides of the plate above the portion 36, but only to the side remote from the channel means 31,32 between the convergent tops of said channel means 31,32, as is apparent in FIGS. 2 to 5.

The bracket 40 is a mirror image of the bracket 30, and the same reference numerals are used in FIG. 1 to denote corresponding parts.

In use, the brackets 30,40 are mounted, as shown in FIG. 1, onto respective sides of the erect step ladder 10, with the shorter channel means 31 of each engaging around the respective rails 14, and the adjustable channel means 32 of each engaging around the respective rails 16. At this stage the angular positions of the channel forming profiles 32 should be adjusted, if necessary, for snug fit of the channels 31, 32 onto their rails 14,16, and also so that their top flanges 35 lie substantially horizontal.

The support portions 36 of the bracket 30,40 extend away from the rails 16, in a direction remote from the rails 14. With the brackets 30,40 securely mounted, their substantially horizontal top flanges 35 provide support for the tray 50 which is then positioned to rest thereon. Side extensions 52,57 of the tray 50 project sideways beyond the flanges 35 and also in the direction of the rails 14.

The tray 50 also has an upwardly projecting rim 54 around all its edges, including of the side extensions 52,57.

Slots 53 are provided in the tray 50 and apertures 38 are provided in the support flanges 35 of each bracket 30,40 (see FIG. 5), and fastening means, such as bolts 41, are used to project therethrough and secure the tray 50 to both of the brackets 30,40. So long as fastening takes place at a position spaced from the end of the flange 35, the tray 50 is stably supported and not liable to upsetting.

Figure 7:
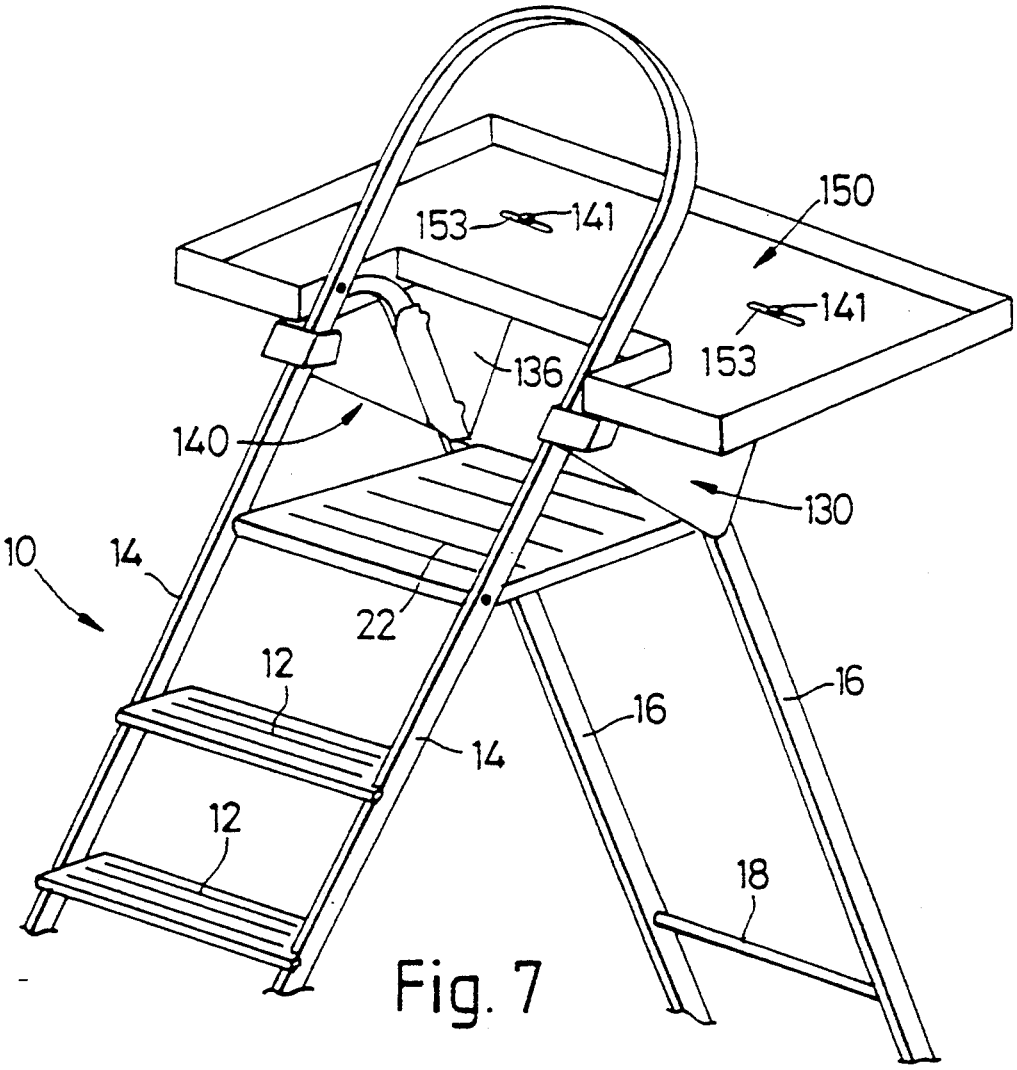
FIG. 7 is a diagrammatic perspective view of a second embodiment of the attachment assembly of the invention mounted onto an upper part of a hinged step ladder.
Figure 9:
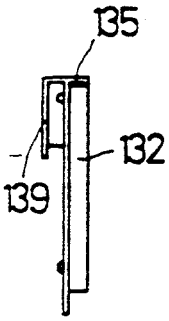
FIGS. 8 to 12 are schematic views similar to FIGS. 2 to 6 of one bracket of the assembly of FIG. 7.
Figure 8:
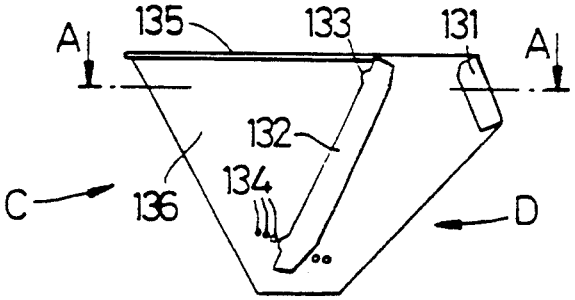
Figure 10:
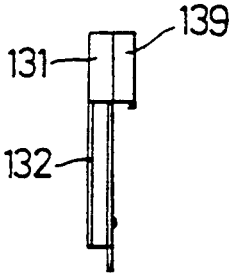
Figure 11:
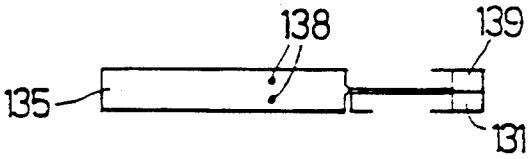
Figure 12:
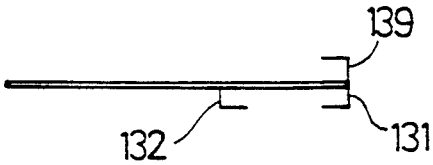

Turning now to FIG. 7, this shows a second embodiment of assembly mounted on the same style of step ladder, in respect of which the same reference numerals as in FIG. 1 are used.

In this case, the assembly comprises two brackets 130,140 and a tray 150. The tray 150 is the same as the tray 50 of the first embodiment and need not be described further. It is in the construction of the brackets 130,140 where this version differs from the first embodiment. Instead of being fabricated as mirror images, like the brackets 30,40 these brackets 130,140 are, in fact, of identical form, but in use are assembled as mirror image right and left side brackets by mounting of channel means 132 to opposing surfaces of the respective brackets.

By referring also to FIGS. 8 to 12, which show one of the brackets 130, it will be seen that respective back to back channel means 131,139 (see FIGS. 11 and 12) are integrally formed as L-sectioned lateral projections at opposing sides of an oblique front edge of the plate-like bracket 130. The other channel means 132, in the form of a separate L-sectioned profile, can be connected to either surface of the bracket 130, thus in spaced divergent relation to either the channel formed by projection 131 or that formed by projection 139. As in the first embodiment, the profile 132 is pivotally connectable at 133, near its upper end, and its lower end is connectable at any selected one of a plurality of positions as defined by an arcuate arrangement of apertures 134. In this way, the angle of the channel means 132 relative to the channel means 131 or 139 can be adjusted.

A top flange 135 of the bracket extends to both sides only above a tray supporting portion 136 which extends beyond the position of the channel means 132.

In other respects, the manner of mounting the brackets 130 and 140 and the tray 150 onto the step ladder are as in the first embodiment, with slots 153 provided in the tray 150 and apertures 138 in the flange 135 for fastening means 141.

Figure 13:
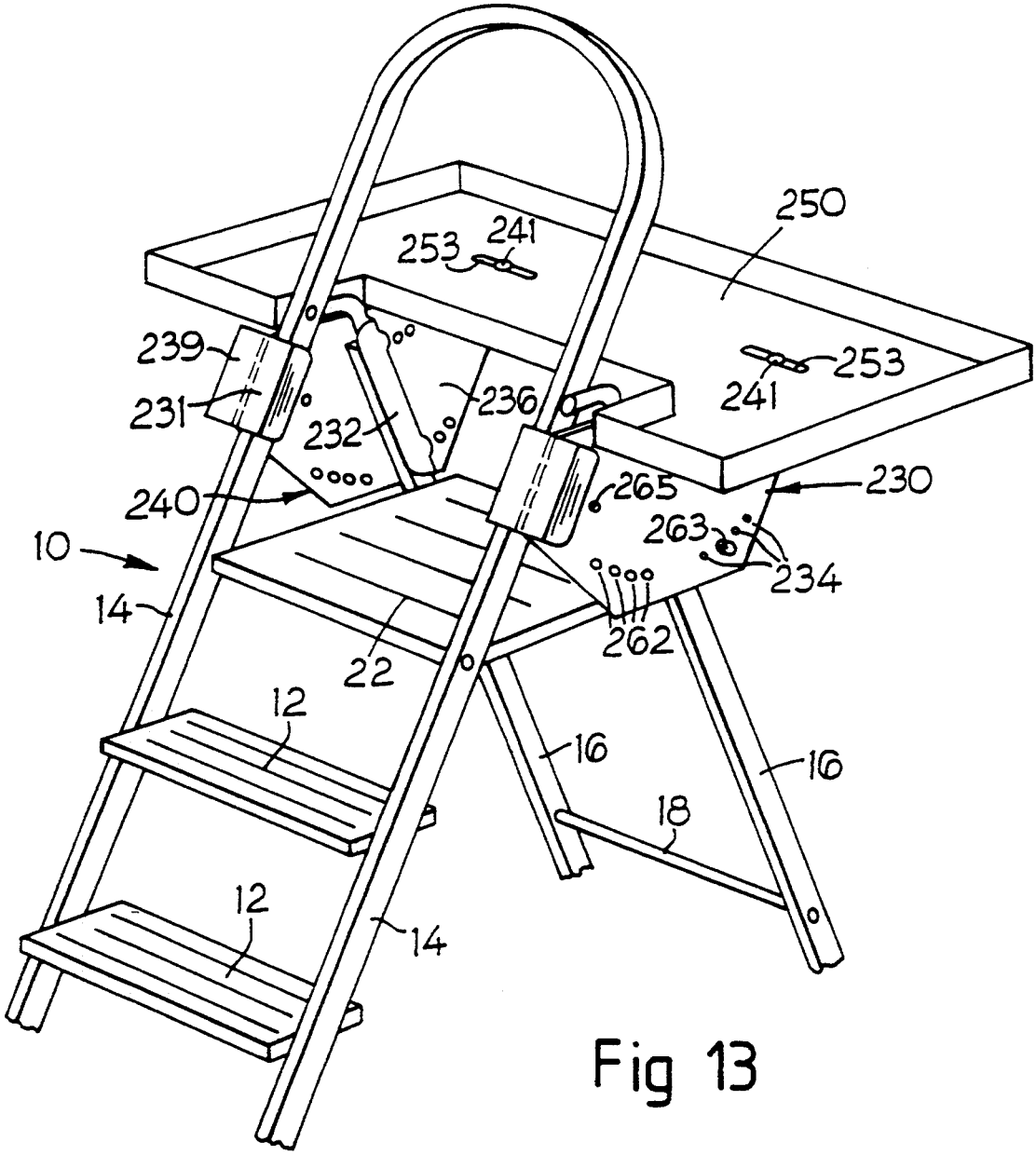
FIG. 13 is a diagrammatic perspective view of a third embodiment of the attachment assembly of the invention mounted onto the upper part of a hinged step ladder.

Turning now to FIG. 13, this shows a third embodiment of assembly mounted on the same style of hinged step ladder as in FIGS. 1 and 7, in respect of which the same reference numerals as in those figures is used.

In this case, the assembly comprises two brackets 230, 240 and a tray 250. The tray is the same as the trays 50, 150 of the previous embodiments and need not be described further. Its features and fixing means are demoted by the same reference numerals as in the previous embodiments but elevated by 200.

The brackets 230, 240 are similar to those of the second embodiment in that they are identical to each other, but in use are assembled as mirror image left and right side brackets by mounting of channel means 232 to respective opposing surfaces thereof. Thus, as in that second embodiment, respective back to back channel means 231, 239 are integrally formed as L-sectioned lateral projections at opposing sides of an oblique front edge of each main part of each bracket 230, 240, and the other channel means 232, in the form of a separate L-section profile, can be connected to either surface of the main part of the bracket so as to co-operate, in use, with either the channel formed by the projection 231, or that formed by the projection 239. Also, as in the second embodiment, the profile 232 is pivotally connected near its upper end while its lower end is connectable at any selected one of a plurality of positions as defined by an acute arrangement of apertures 232. In this way, the channel means 232 can be mounted to diverge downwardly from the channel means 231 (or 239) and its angle can be adjusted so that the brackets fit to respective sides of an opened hinged step ladder, as shown in FIG. 13.

Compared to the second embodiment, however, this third embodiment additionally has the facility for fitting to a straight ladder, or for fitting to only one limb of a hinged step ladder at each side. Thus it is more versatile.

Figure 14:
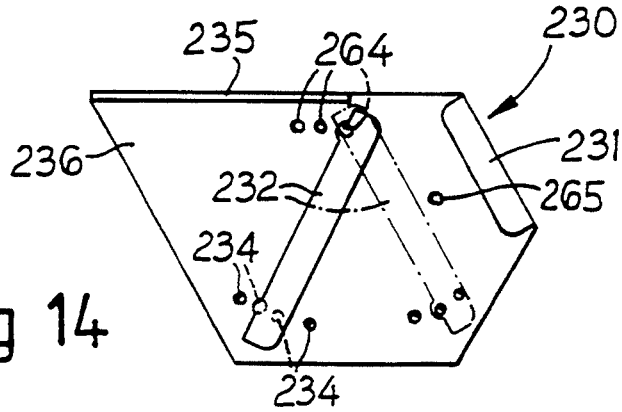
FIG. 14 is a schematic side view of one of the brackets of the assembly of FIG. 13.
Figure 15:
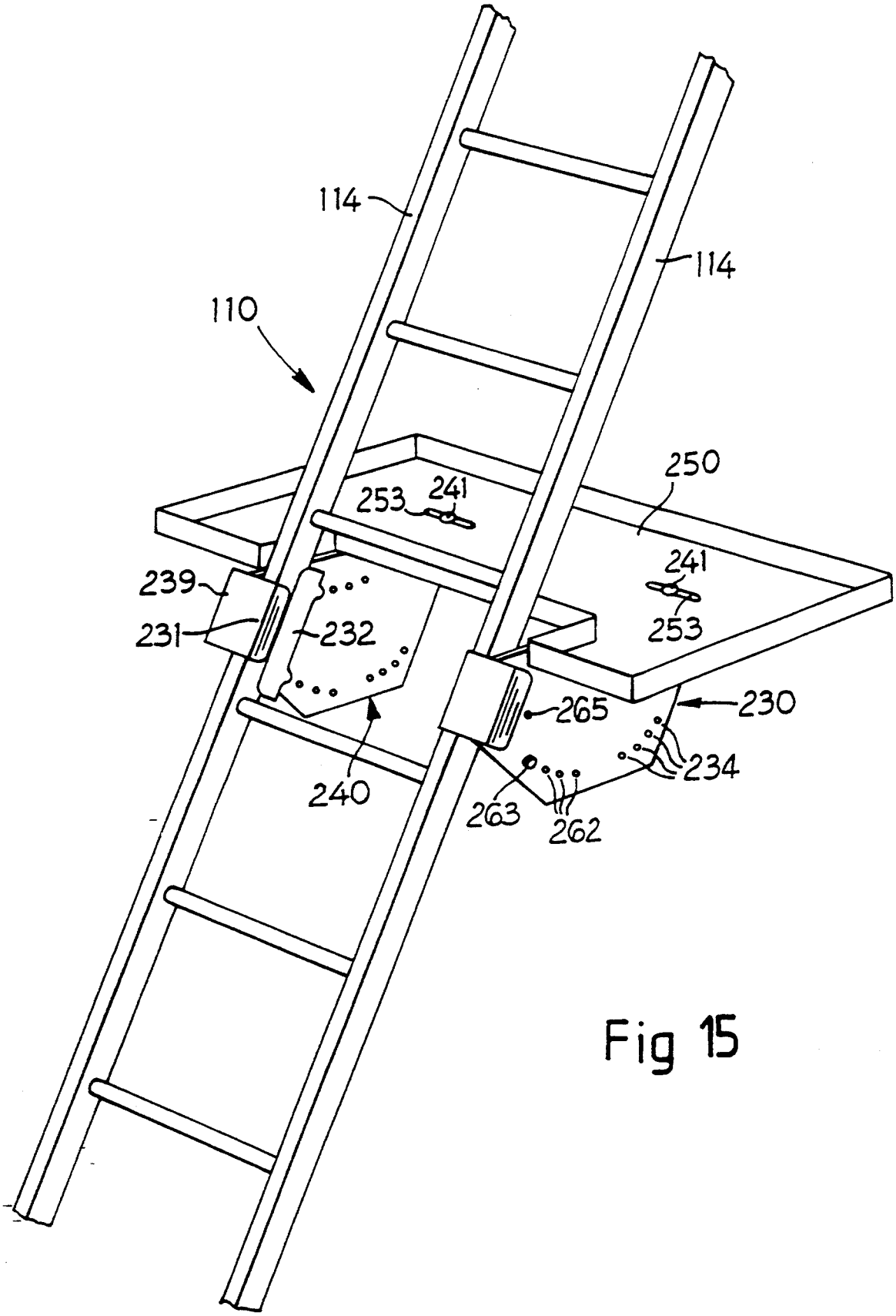
FIG. 15 is a diagrammatic perspective view of the same third embodiment of assembly mounted onto a straight ladder.

This is accomplished quite simply by having a second acute arrangement of apertures 262, as shown in all of FIGS. 13 to 15, so that the channel means 232 of each bracket 230, 240 can be swung round to lie substantially parallel to the channel means 231 (or 239) with its lower end then secured in this position via a wing nut 263 though one of these apertures 262. To allow for this alignment of the channel means 232, plural apertures 264 are provided for pivotal mounting of the top of said channel means (e.g. via a similar wing nut). Also the shape of the plate-like main part of each bracket 230, 240 is enlarged, as best appreciated by reference to FIG. 14. Once the channel means 231, 232 (or 239, 232) are appropriately aligned substantially parallel, they provide facing channels which will engage opposing sides of a single ladder limb 114, at each side of the ladder 100, for example as shown in FIG. 15. To secure the brackets, i.e. to prevent them sliding down the limbs 114, grub screws or the like (not shown) should preferably be applied via additional apertures 265 to brace the brackets relative to the limbs 114.

In other respects, the brackets are the same as in FIGS. 7 to 12 in having flanges 235 and tray supporting portions 236 and the manner of mounting the tray 250 thereon is the same, no matter to which type of ladder the assembly is fitted.

The illustrated embodiments are merely exemplary and many other constructional variations are possible within the scope of the invention.

In particular, in certain other embodiments spaced, divergent channel forming means for engaging rails 14,16 at one side of a hinged ladder 10 may both be integrally formed with or non-adjustably attached to each bracket. In such embodiments, with fixed channel means, the angle therebetween may not exactly match the angle between the rails of any particular step ladder.

To enable secure fitment and prevent any unwanted rocking of the brackets grub screws may be used to hold the brackets firmly in place at each side of the latter.

In other embodiments the bracket itself may be formed of two plate-like parts which are hingedly connected, each part carrying one of the channel forming means. In yet other embodiments the channel forming means may be of reduced extent compared to the illustrated embodiments, and may consist essentially of a plurality of hooks with gaps therebetween, each hook providing a short section of the channel whereby the relevant ladder rail is engaged. Also, the separate channel forming means, when provided, may be of channel section form instead of L-section. The tray of the assembly need not have side extensions, nor a rim. Other variations and additional provisions are possible.

What is claimed is:

1. A ladder attachment assembly for a hinged ladder having opposed sides, each side having first and second limbs diverging downward from upper portions thereof, said first limbs paralleling each other and said second limbs paralleling each other, at least said first limbs having a flight of steps supported therebetween, said second limbs comprising a support diverging from said flight of steps, said attachment assembly comprising a pair of brackets, each said bracket having spaced apart divergent first and second channel means for engagement around the diverging first and second limbs of said hinged ladder at respective sides thereof, each said bracket having a support portion extending beyond the first channel means in a direction away from the second channel means, a platform for tools, materials and the like dimensioned to extend across the support portions of both of the brackets for support thereon, when the latter are mounted on the hinged ladder, and means for securing said platform to both said support portions.

2. An assembly as claimed in claim 1 including means for mounting one of the first and second channel means of each bracket for adjustment in position relative to the other channel means of that bracket.

3. A ladder attachment assembly comprising a pair of brackets each said bracket having spaced apart first and second channel means adapted for engagement around limbs of a ladder at respective sides thereof and each said bracket having a support portion extending beyond the first channel means in a direction away from the second channel means, a platform receivable on said support portions of the brackets for support thereby, and means for securing the platform to both said support portions, means for mounting one of said first and second channel means of each bracket for adjustment relative to the other channel means of that bracket for selectively positioning the two channel means substantially parallel to each other for fitting to single limbs of a ladder, and divergent from each other for engagement around separate divergent limbs of a hinged ladder.

4. An assembly as claimed in claim 2 or 3 wherein said means mounting said one of said channel means for adjustment is a pivot means mounting said first channel means for adjustment relative to said second channel means so that the angle between the respective channel means of each bracket can be varied to accommodate variations in the angle between the opened limbs of a hinged ladder.

5. An assembly as claimed in claim 1 or 3 wherein the support portion of each bracket has a top flange providing a support surface for the platform.

6. An assembly as claimed in claim 1 or 3 wherein each bracket is formed in two parts, a main part including one of the channel means and the support portion, and an auxiliary part including the other of the channel means which is slidably or pivotally adjustable laterally relative to said one of said channel means on the main part.

7. An assembly as claimed in claim 6 wherein the main part of each bracket includes a third channel means disposed back to back with the first or second channel means.

8. An assembly as claimed in claim 7 wherein the main parts of the two brackets are of identical configuration.

9. A hinged ladder attachment comprising a bracket having a spaced apart divergent channel means for fitting onto separate opened limbs of a hinged ladder at one side thereof and having an extension projecting beyond one of the channel means in a direction away from the other of the channel means to provide support for a platform, said spaced divergent channel means being pivotally adjustable relative to each other to vary the angle of divergence between the respective channel means to accommodate variations in the opened limbs of hinged ladders.

10. A ladder attachment comprising a bracket having spaced apart channels for engaging onto limbs of a ladder at one side thereof and having an extension projecting beyond one of the channels in a direction away from the other of the channels to provide support for a platform, means for adjustably mounting at least one of the channels for movement between a first position substantially parallel to the other channel for engaging said channels to a single limb of a ladder and a second position wherein said channels are divergent from each other for engagement around opened separate limbs of a hinged ladder.

11. A hinged ladder attachment assembly comprising a pair of brackets each said bracket having spaced apart divergent first and second channel means for engagement around opened limbs of a hinged ladder at respective sides thereof and each said bracket having a support portion extending beyond the first channel means in a direction away from the second channel means, a platform capable of being supported by the brackets by being dimensioned to extend across the support portions of both of the brackets, when the latter are mounted on the ladder, and means for securing the platform to both said support portions, each bracket being formed in two parts, a main part including one of the first or second channel means and the support portion, and an auxiliary part including the other of the channel means which is slidably or pivotally adjustable relative to the main part, the main part of each bracket including a third channel means disposed back to back with the first or second channel means.

12. An assembly as claimed in claim 11 wherein the main parts of the two brackets are of identical configuration.

* * * * *